United States Patent [19]

Heger et al.

[11] 4,284,985

[45] Aug. 18, 1981

[54] STOLEN EQUIPMENT RECOVERY DEVICE

[75] Inventors: Vernon G. Heger, 3517 Albatross, San Diego, Calif. 92103; Henri J. A. Charmasson, San Diego, Calif.

[73] Assignee: Vernon G. Heger, San Diego, Calif.

[21] Appl. No.: 126,307

[22] Filed: Mar. 3, 1980

[51] Int. Cl.[3] ..... G08B 13/22

[52] U.S. Cl. ..... 340/572; 340/539; 340/694

[58] Field of Search ..... 340/539, 552, 565, 567, 340/568, 572, 694

[56] References Cited

U.S. PATENT DOCUMENTS

| | | | |
|---|---|---|---|
| 3,747,086 | 7/1973 | Peterson | 340/572 |
| 3,798,642 | 3/1974 | Augenblick et al. | 340/572 |
| 3,944,928 | 3/1976 | Augenblick et al. | 340/572 |
| 3,990,065 | 11/1976 | Purinton et al. | 340/572 |

*Primary Examiner*—Alvin H. Waring

*Attorney, Agent, or Firm*—Charmasson, Branscomb & Holz

[57] ABSTRACT

A method and necessary apparatus for detecting the unauthorized operation or asportation of mobile or portable equipment. The apparatus comprises a concealable transmitter designed to re-transmit a coded message received from a check station. The check station may be stationary such as at the exit gate of a garage or at a fixed checkpoint along a thoroughfare; or may be carried on a vehicle such as a police car or other type of security patrol. The concealed repeating transmitter is switched on or off by means of a pocket-sized short-range coded remote switch unit not unlike those used for the remote control of household television receivers.

11 Claims, 1 Drawing Figure

STOLEN EQUIPMENT RECOVERY DEVICE

FIELD OF THE INVENTION

This invention relates to electronic security devices and more particularly to hidden transmitters used for locating stolen equipment.

BACKGROUND OF THE INVENTION

Vehicular theft constitutes a high percentage of reported criminal acts. Yet, because of the number of vehicles traveling the highways, the identification of stolen vehicles is practically impossible. If the stolen vehicle is driven across the national border, the chance of recovery is virtually non-existent. Some vehicles are even stolen from attended garages and parking lots and thieves' ingenuity has overcome the most complex and safest mechanical locking devices.

It has been proposed in the past to conceal on board vehicles radio frequency transmitters which would be triggered into operation by the motion of the vehicle. Directional radio finders could then be used to locate the vehicle once its theft has been reported to the authority. To be practical, such devices should be powerful enough to transmit over a range of several miles and for a period of time spanning several days. The size of the batteries required to power such transmitter and of other components would interfere with their easy concealment on the monitored equipment.

Kidnapping for ransom or for political motives is almost a daily occurrence throughout the world. Most countermeasures against this type of criminal activity have been mostly preventive. Once a person has been kidnapped, means are seldom available to determine his whereabouts. A kidnap victim may even be walked out of his residence or place of work under the threat of a concealed weapon under the unsuspecting eyes of relatives, co-workers or security guards.

There is, therefore, a need for a signalling device small enough to be concealed within an object, in the lining of a piece of clothing or even under the skin of a potential kidnap victim and which would transmit a distress signal unbeknown to the crime perpetrator.

SUMMARY OF THE INVENTION

The principal object of this invention is to provide a method and apparatus for the early detection of the unauthorized removal or movement of a person, vehicle, or transportable equipment. Another object of this invention is to provide a device for signalling such unauthorized removal or movement which is small enough to be easily concealed on the monitored person, vehicle or equipment. A further object of this invention is to provide such an alerting device which is normally silent but will respond in inquiry from a stationary or mobile check station by transmitting back toward the check station a distress message. These and other objects are achieved by a miniaturized device, including a repeating transceiver designed around a simple shift register. An ultrasonic remote control switch is used to turn the device on or off. The device can be interrogated from a check station which transmits a short coded message, then listens for its echo from an activated transceiver which would be present in the immediate surrounding area. The check station may be stationary, such as the exit gate of a garage or a border checkpoint. It could also be installed on a roving patrol car, on board a harbor police craft, or carried by a helicopter.

DESCRIPTION OF THE PREFERRED EMBODIMENT

Figure 1:
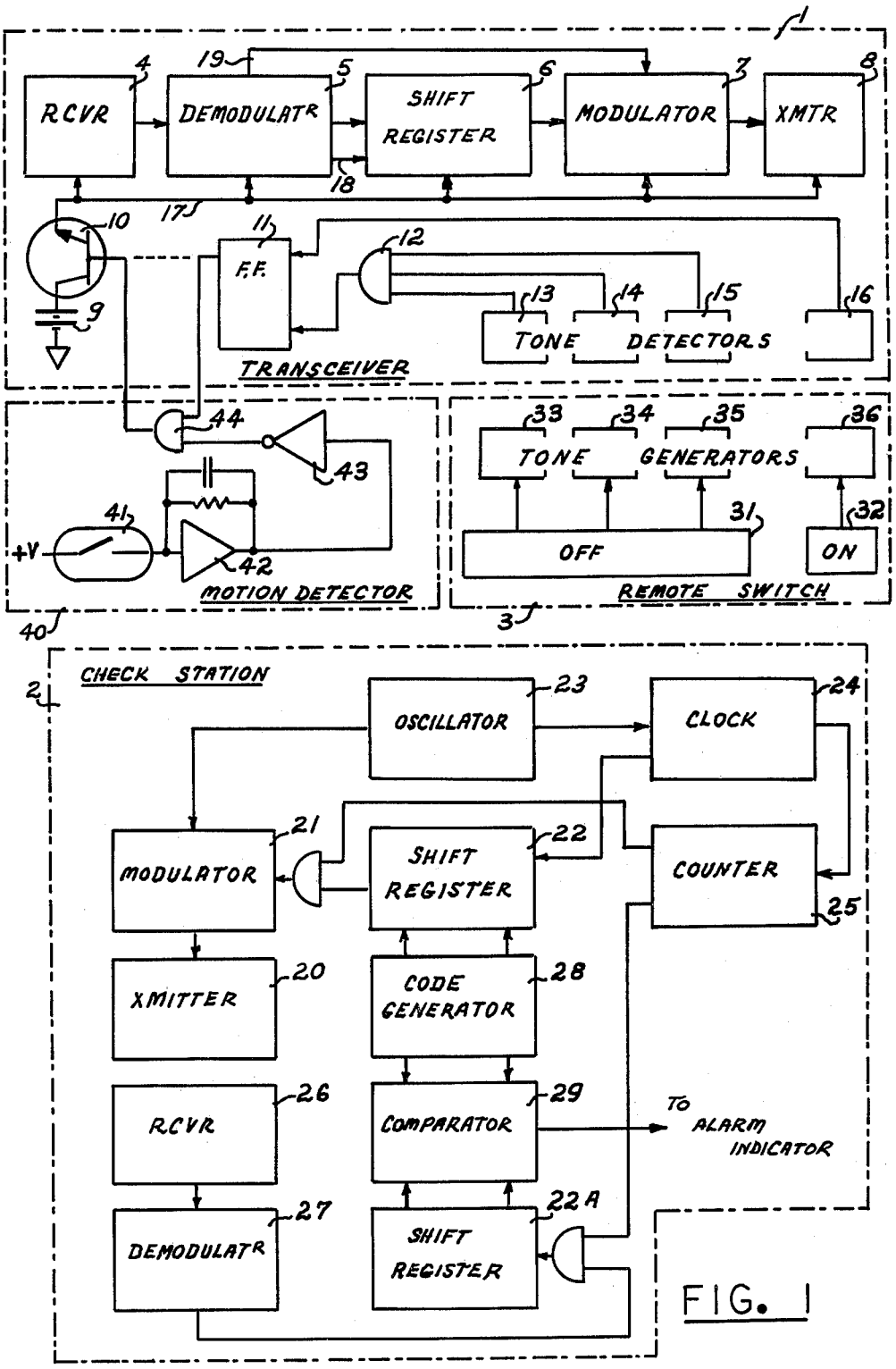
FIG. 1 is a general block diagram of the entire recovery device.

Referring now to the drawing, and in accordance with the invention, there is illustrated in block 1 the various elements of a repeating transceiver. The transceiver comprises a radio frequency receiver 4 followed a demodulator 5. The information signal issuing from the modulator 5 is fed into a shift register 6 under control of a clock signal 18 derived from the RF signal. The serial output of the shift register is fed into a modulator 7 which in turn drives a radio frequency transmitter 8. The modulator obtains the carrier frequency 19 directly from the demodulator 5. From the above description, it can be understood that any pulse duration coded signal which is received by the transceiver 1 will be transmitted back after a certain delay proportional to the clock frequency 18 and the number of stages in the shift register 6. The transceiver 1 is powered by a battery 9 whose output is controlled by a power transistor 10. The bias on the gate of the power transistor 10 is dependent upon the status of a flip-flop 11. The flip-flop 11 is toggled in response to a series of ultrasonic frequency detectors 13 through 16. The flip-flop 11 is set by the output of detector 16 and reset by the combined outputs of detectors 13, 14 and 15 anded by gate 12.

Block 3 represents a portable, pocket-sized remote controlled on/off switch not unlike the remote control unit used in conjunction with household TV receivers. The remote switch 3 has an on pushbutton 32 which controls an ultrasonic generator 36 tuned to the receiving frequency of the detector 16. The off switch 31 acts in parallel upon three ultrasonic frequency generators 33, 34 and 35 whose frequencies are tuned to their corresponding detectors 13, 14 and 15 on the transceiver 1. The portable remote control switch 3 acts like a coded key in the possession of the authorized operator which must be operated not only to activate the transceiver 1 but also to silence it.

Block 40 represents a motion detector through which the signal out of the flip-flop 11 is run before reaching the power transistor 10. The motion detector 40 comprises accelerometer or motion sensitive switch 41 whose output is fed into an integrating amplifier 42 and a gate 44 controlled with the inverted output of the integrating amplifier 42. The gate 44 will be maintained open by the repeated or steady closure of the switch 41 when the body upon which the device is installed is moved. Once the transceiver has been activated by way of the on button 32 on the remote switch 3, any motion will cause the power from the battery 9 to be applied to the various receiving and transmitting elements. The transceiver 1 can only be switched off by a person having possession of a remote switch 3.

The simplicity of the transceiver 1 allows for a high degree of miniaturization. When used in conjunction with a vehicle, the transceiver 1 and motion detector 40 could easily be concealed within one of the external accessories. When used as an anti-kidnapping device, the transceiver could conceivably be concealed within the thickness of clothing material or be packaged for sub-cutaneous installation.

Block 2 represents a check station capable of interrogating the repeating transceiver 1. The check station 2 comprises a shift register 22 receiving in parallel a pulse duration coded signal 28. The serial output of the shift register 22 is fed to a modulator 21 wherein the radio frequency generated by the oscillator 23 is modulated with the coded signal before being transmitted through the radio frequency transmitter 20. The oscillator output is counted down through a clock divider 24 to provide the shift control signal. The output of the clock divider 24 is also fed to a sequence counter 25 whose last stage controls alternately the output of the first shift register 22 or the input into a second shift register 22A. The latter is designed to receive the returning echo signal from the transceiver through receiver 26 and demodulator 27. Once the echo signal has been loaded into the second shift register 22A, it is compared to the initial transmitted message 28 by means of a parallel comparator 29. The comparator output is used to trigger an alarm indicating that an activated repeating transceiver is within the immediate surrounding area of the check station 2.

Depending upon the type of body to be monitored, the repeating transceiver 1 may be used in conjunction with or without the motion detector 40. In the absence of the motion detector, the output of flip-flop 11 is connected directly to the gate of the power transistor 10.

While I have described the preferred embodiment of the invention and suggested a particular type of interactive communication between the check station 2 and the transceiver 1 carried by the monitored body, other embodiments may be devised and different message formats may be used without departing from the spirit and the scope of the appended claims.

What is claimed is:

1. A device for detecting the unauthorized movement or asportation of a body which comprises:
   a check station having:
   means for transmitting a first pulse-coded signal;
   means for receiving a second pulse-coded signal;
   means for comparing the first signal to the second signal;
   means, responsive to said means for comparing, for signaling the reception of the second signal;
   on the body, a code-repeating transceiver having:
   means for receiving said first signal;
   means, responsive to said first signal, for transmitting said second signal, said means for receiving comprising:
   a shift register receiving said first signal on its serial input and delivering said second signal on its serial output;
   switchable means for selectively enabling the operation of the code-repeating transceiver.

2. The device claimed in claim 1 wherein said switchable means for selectively enabling comprises:
   means separated from said transceiver for remotely generating an ultrasonic tone;
   means connected to said transceiver for detecting said ultrasonic tone; and
   means, responsive to said means for detecting, for applying a supply voltage to said means for receiving said first signal, said means for transmitting said second signal and said shift register.

3. The device claimed in claim 1 wherein said first signal comprises a radio frequency carrier modulated by a coded pulse train.

4. The device claimed in claim 3 wherein said first and second signals are alike.

5. The device claimed in claim 4 wherein:
   said means for transmitting comprises a modulator and a radio frequency transmitter;
   said means for receiving comprise a radio frequency receiver and a demodulator; and
   said shift register has its serial input connected to the signal output of the demodulator and its serial output connected to the signal output of the modulator.

6. The device claimed in claim 5 wherein the shift register clock and the modulator carrier frequency are derived from the demodulator.

7. The device claimed in claim 2 wherein:
   said means for remotely generating an ultrasonic tone comprise a multi-tone generator actionable by operation of a manual switch;
   said means for detecting comprise a multi-tone detector; and
   said means for applying a supply voltage comprises a motion detector, a power transistor switch in series with a voltage source, said transistor switch being controlled by the status of the multiple tone detector, and the status of the motion deflector.

8. The device claimed in claim 6 wherein said check station is stationary.

9. The device claimed in claim 6 wherein said check station is mobile.

10. A method for detecting the unauthorized movement or asportation of a body which comprises the steps of:
   concealing upon said body a remotely energizable and remotely activable signal-emitting device;
   remotely energizing said signal-emitting device before it is left unattended;
   at a check station,
   emitting a stimulus signal capable of remotely activating said signal-emitting device when said device is in the proximity of said station, said stimulus comprising a carrier frequency modulated by a pulse-train which can be stored and transmitted back from the signal emitting device to the check station;
   listening for a return signal from said signal-emitting device responsive to said stimulus signal;
   interpreting said return signal; and
   in function of said interpretation, indicating the proximate presence of said body.

11. The method claimed in claim 10 wherein the step of remotely energizing said signal-emitting device comprises the step of generating a plurality of ultra-sonic tones detectable by said signal-emitting device.

* * * * *